US005951357A

United States Patent [19]

Mandle et al.

[11] Patent Number: 5,951,357

[45] Date of Patent: Sep. 14, 1999

[54] SKI JUMP AMUSEMENT DEVICE

[76] Inventors: Richard M. Mandle, 22 Arcadia Rd., Woodcliff Lake; Theodore Roxbury, 131 Vineyard Ave., South Amboy, both of N.J. 08879

[21] Appl. No.: 08/773,744

[22] Filed: Dec. 17, 1996

[51] Int. Cl.[6] ..... A63H 33/26; A63H 29/08; A63H 11/00; A63C 19/10

[52] U.S. Cl. ..... 446/138; 446/171; 446/332; 472/90

[58] Field of Search ..... 446/138, 139, 446/137, 136, 134, 129, 169, 171, 332, 330; 472/90

[56] References Cited

U.S. PATENT DOCUMENTS

| | | | |
|---|---|---|---|
| 1,424,659 | 8/1922 | Linder | 472/90 |
| 2,645,879 | 7/1953 | Richter . | |
| 2,673,421 | 3/1954 | Leonard . | |
| 3,126,670 | 3/1964 | Smith . | |
| 3,782,729 | 1/1974 | Ernst | 446/171 X |
| 3,926,435 | 12/1975 | Nacci . | |
| 4,177,592 | 12/1979 | Ruck . | |
| 4,917,644 | 4/1990 | Sunshine | 446/429 X |
| 5,279,871 | 1/1994 | Segan et al. . | |
| 5,651,714 | 7/1997 | Remken | 446/136 |

FOREIGN PATENT DOCUMENTS

| | | | |
|---|---|---|---|
| 543489 | 7/1957 | Canada . | |
| 671384 | 2/1939 | Germany | 446/332 |
| 2325234 | 11/1974 | Germany . | |

*Primary Examiner*—D Neal Muir
*Attorney, Agent, or Firm*—Carol D. Titus; James J. Leary

[57] ABSTRACT

A magnetic strip of material formed into a loop which is placed around two pulleys. The pulleys rotate, thereby moving the magnetic strip. Skiers have skis which are attracted to the magnetic strip and are thereby moved with the loop as the loop is pulled around the pulleys. As the skier reaches the top of the upper pulley, the ski is lifted off the magnetic strip and onto the ski jump ramp. At the top of this ramp, the skier is held by a magnet located beneath the top of the ramp. Rotating with the upper pulley is a cam which moves the magnet at the top of the ramp between two positions. The first positions holds the magnet against or adjacent to the underside of the ramp holding the skier at the top of the ramp and the second position holds the magnet rotated slightly away from the ramp which releases the figure to descend the ramp and perform its ski jump. Optionally there is a flag that drops when the magnet releases the skier. After the skier is released, he slides down and off the ramp and free falls until he lands on the magnetic strip. He is again held by magnetic force to the magnetic strip and drawn around the bottom of the lower pulley, back up around the top and onto the top of the ramp to make another jump.

26 Claims, 6 Drawing Sheets

SKI JUMP AMUSEMENT DEVICE

FIELD OF INVENTION

The present invention relates generally to magnetic amusement devices. More particularly it relates to a miniaturized ski jump with figures performing ski jumps.

BACKGROUND OF THE INVENTION

Children of all ages like to watch moving figures and animated toys. Over the years many devices of this nature have been devised. These devices use an assortment of mechanisms to create movement. For example, Canadian patent number 543,489 to Davidson discloses a continuous loop with a magnet and a counterweight. An object or toy is magnetically attracted and drawn upward by the magnet as the counterweight descends. In this case, after each use, the device must be inverted to allow the counterweight to return to its starting position. U.S. Pat. No. 3,126,670 discloses a toy motorcycle which climbs a steep hill. The motorcycle is drawn by a magnet on a string. The string is wound onto a drum as the magnet and motorcycle are drawn up the mountain. Again, the string and magnet must be reset after each use.

Magnets are used in many devices to hold parts of toys and other devices in place. Particularly, there are a number of patents such as U.S. Pat. Nos. 2,645,879 to Richter and 4,177,592 to Ruck which use two magnets (or a magnet and a magnetized material), one on a skater figurine and one beneath the display surface on a mechanical arm to move the figures around a skating rink. These devices are an improvement over the previous devices which use a mechanical link between the skater and the arm. However, this system has several drawbacks. First, the skater is constantly rubbing against the rink surface, and as we all know from looking at an ice rink, this mars the surface of the ice. In this type of animated device, the movement will mark up the rink surface in a particular pattern that will show the exact path the skater takes on each loop. In reality, because the skater is held to its pattern by a magnet below the surface, this marring takes place at a faster rate because the force applied by the magnet is added to the force of gravity.

U.S. Pat. No. 5,279,871 to Segan et al. discloses a skiing Santa Claus that circles a track. The Santa figure is on skis which have rollers beneath them so that the figure can easily roll down the track. The lifting mechanism for the ski lift is a hook which engages a link between the two skis.

U.S. Pat. No. 3,926,435 to Nacci discloses a ski slalom course. The skiers have magnets mounted on the tops of their heads and wheels on their skis. The magnet hooks to "ferrous deposits" on a belt which acts as a ski lift. The figures are intended for racing down the course on the wheeled skis. Several users compete to see whose skier can follow the track without falling.

U.S. Pat. No. 2,673,421 to Leonard shows a ski lift and mountain slope having multiple tracks. Individual magnets are run on a single ascending track and two upper and two lower descending tracks. These magnets drag the skiers up to the top of the mountain and keep them on a combination of one of the upper tracks and one of the lower tracks as the ski figure descends the mountain. As in the case with the skating rink, this will mar the particular tracks the skiers use and thereby detract from the visual appeal of the device. There is no provision for the skier to even momentarily leave magnetic contact with the guiding magnet.

All of these ski lift devices require that the figure wait at a location at the base of a mountain for a hook or magnet to pick them up to draw them to the top of the mountain. Because of the discrete magnets, they also require that the guiding magnet provide the only external force on the figure. If anything moves the figure in any direction and takes the figure out of magnetic contact with the magnet the figure will forever be off the track. In cases where the figure is out of contact with the guide magnet, the figure waits at a location to be picked up by a guiding magnet. These devices could not be used in a ski jump environment because the skiers would be too likely to miss the discreet magnets.

SUMMARY OF THE INVENTION

In keeping with the foregoing discussion, the objective of the present invention is to provide a ski jump amusement device which has miniature ski jumpers who repetitively jump off the ski jump and land on a track.

A further objective of the present invention is to have the skiers automatically returned to the top of the ski jump and prepared for a another jump.

Another objective of the present invention is to provide a delay device for holding the skier temporarily at the top of the ramp so the skier appears to be readying him or herself for the jump. An additional feature which may be added is a flag which drops as the ski figure begins its run.

Yet another objective of the present invention is to have a mechanism for correcting the orientation of the skier if the skier lands sideways or backwards.

A further objective of the present invention is to provide adjustability of the ski jump. This should allow the user to choose the angle at which the ramp is located with respect to the landing slope as well as the angle of the landing slope to the surface on which the entire ski jump mechanism is located.

In keeping with these objectives, the present invention takes the form of a flexible strip of magnetic material which is formed into a loop. This loop is placed around two pulleys which continuously rotate, thereby continuously moving the magnetic strip. Skiers have skis which are attracted to the magnetic strip and are thereby moved with the loop as the loop is pulled around the pulleys. As the skier reaches the top of the upper pulley, the ski is lifted off the magnetic strip and onto a ski jump ramp. At the top of this ramp, the skier is held by a magnet located beneath the top of the ramp. Rotating with the upper pulley is a cam. This cam moves the magnet at the top of the ramp between two positions. The first of these positions holds the magnet against or adjacent to the underside of the ramp which holds the skier at the top of the ramp. In the second position, the magnet is rotated slightly away from the ramp which releases the figure to descend the ramp and perform its ski jump. Also attached to the cam is a pole with a flag. This flag is dropped as the skier is released. After the skier is released, he slides down and off the ramp and free falls until he lands on the magnetic strip. He is again held by magnetic force to the magnetic strip and drawn around the bottom of the lower pulley, back up around the top and onto the top of the ramp to make another jump. Other objects and advantages of the invention will no doubt occur to those skilled in the art upon reading and understanding the following detailed description along with the accompanying drawings.

DETAILED DESCRIPTION OF THE INVENTION

Figures 1, 5:
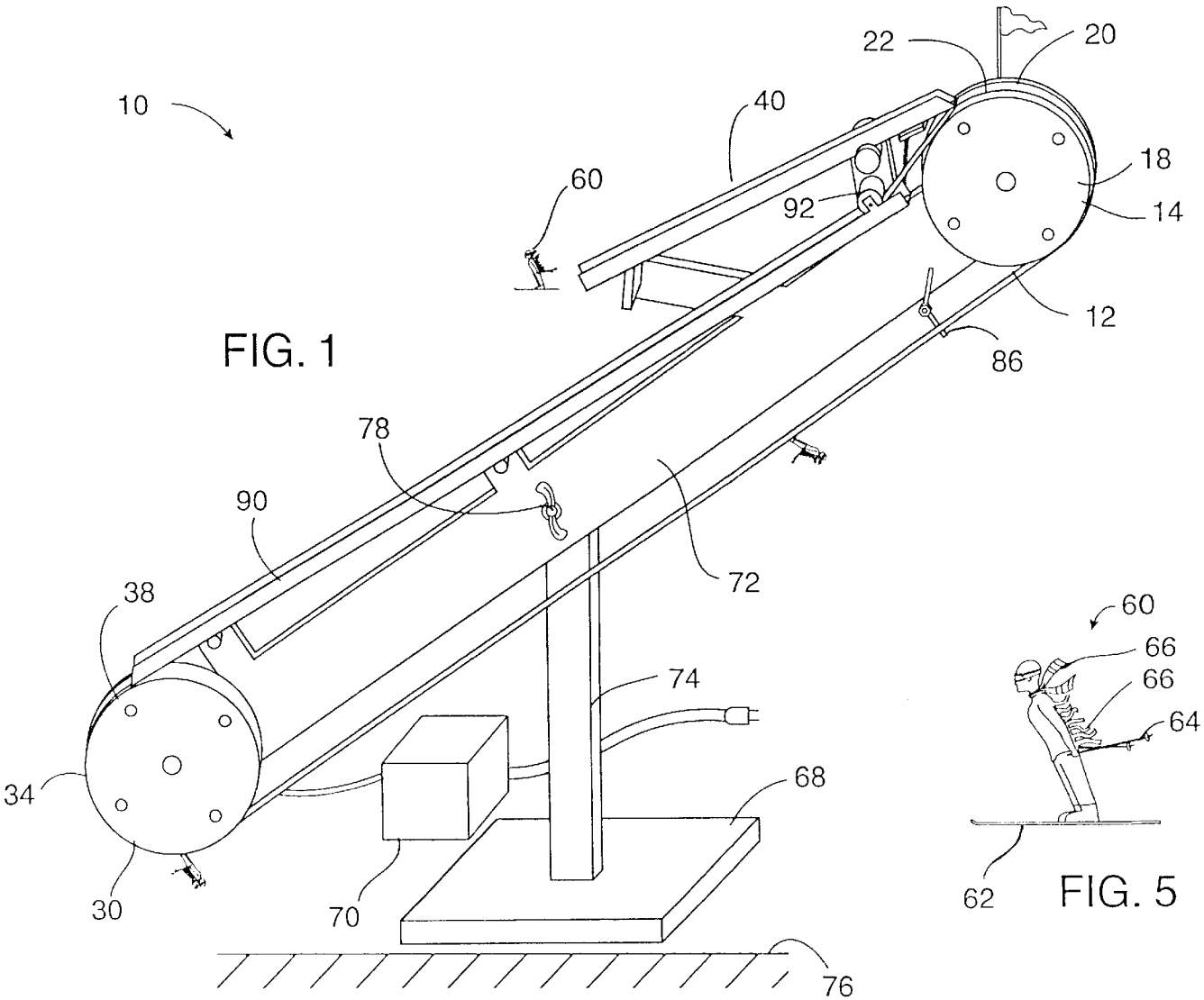
FIG. 1 is a front view of the ski jumping device.
FIG. 5 is a side view of a skier figurine.
Figure 2:
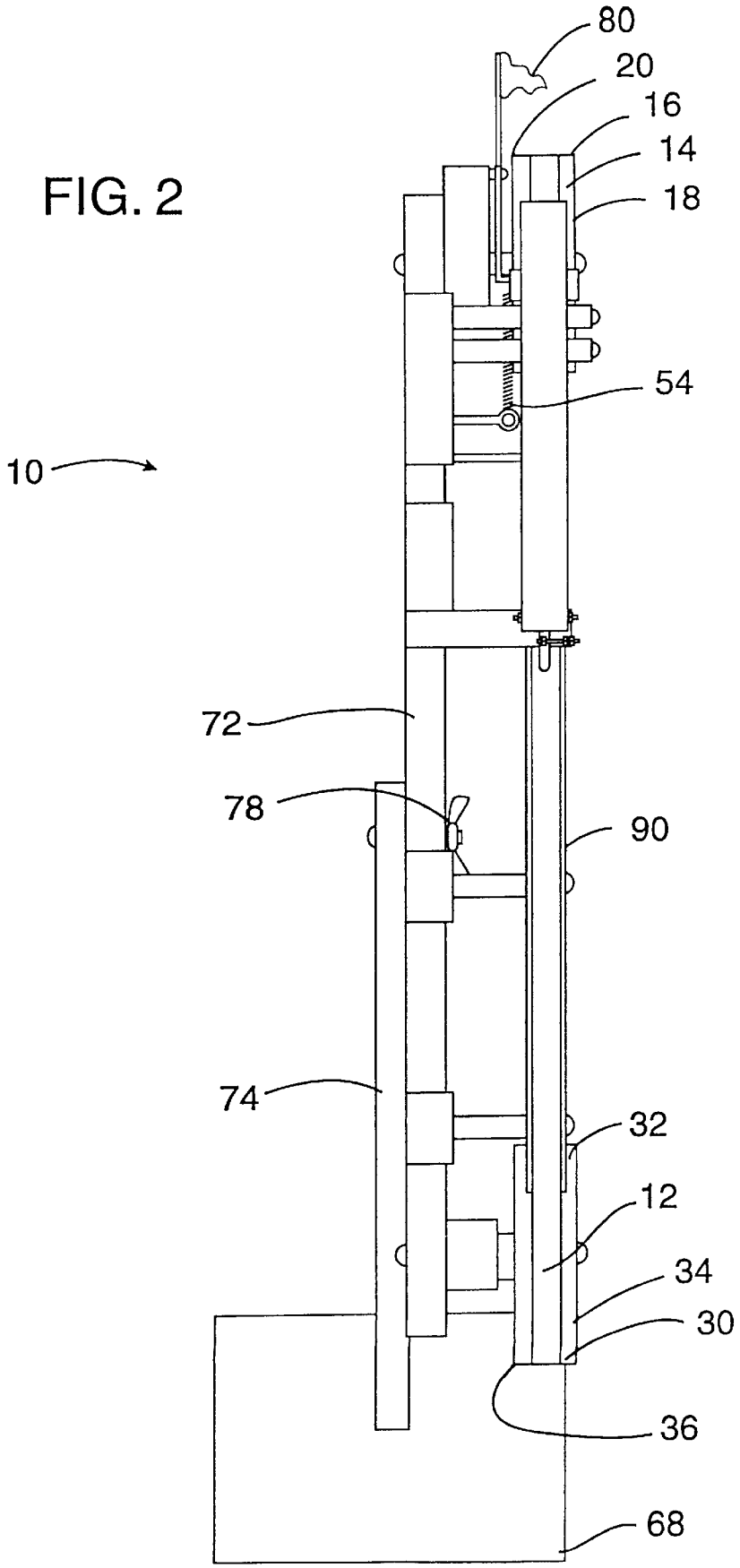
FIG. 2 is a top view of the ski jumping device.
Figure 4A:
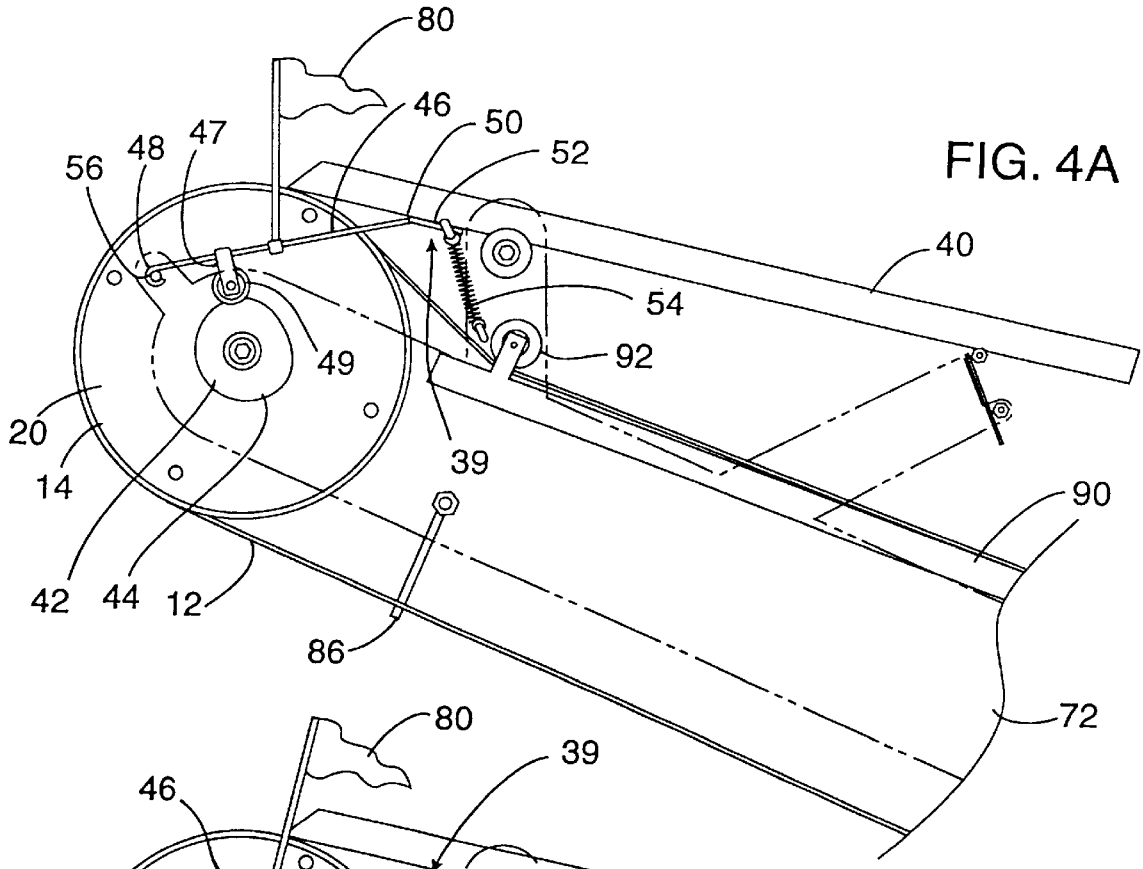
FIGS. 4A and B are close-up back views of the ski jumping device showing the skier release mechanism.
Figure 4B:
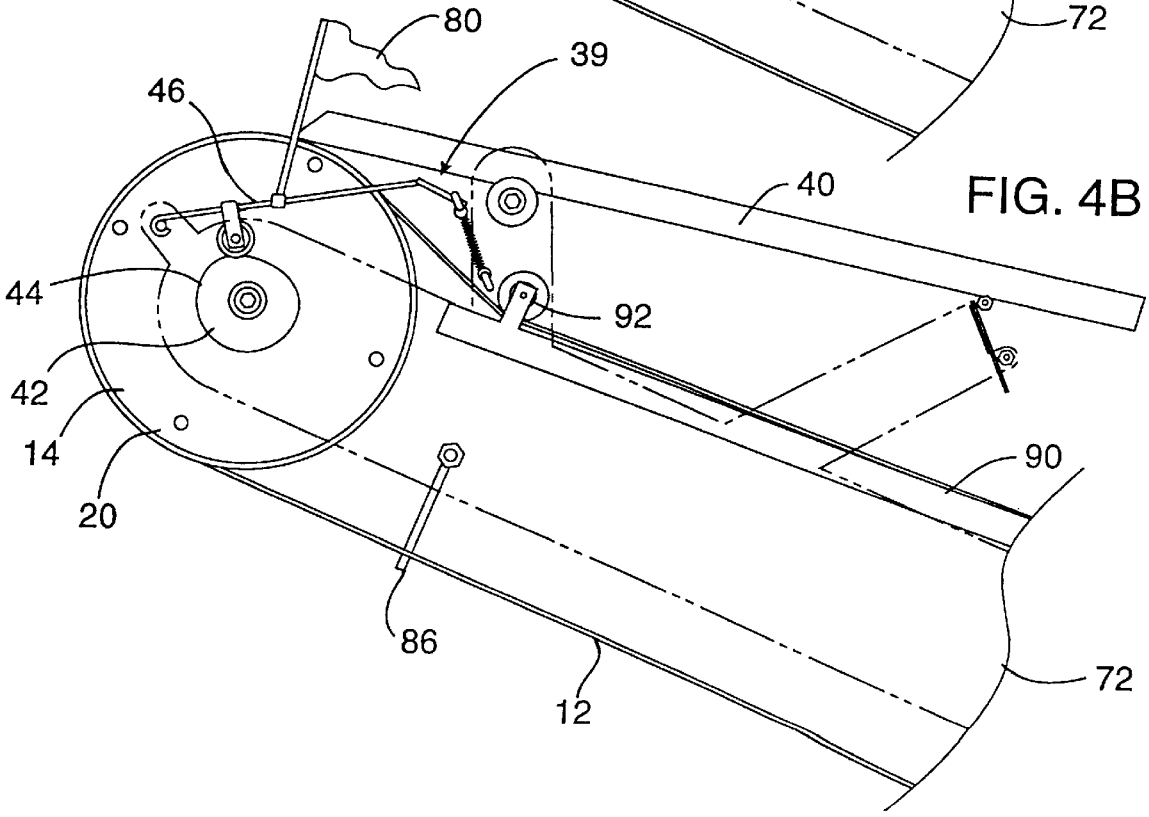

FIG. 1 is a front view and FIG. 2 is a top view of the ski jumping device 10. A flat, flexible, magnetic strip is used to form a continuous or endless loop 12 which is located around an upper pulley 14 and a lower pulley 30. To provide extra friction on the pulleys 14, 30, the loop 12 could be formed of a rubberized, magnetic material. The pulleys 14, 30 are supported by a central frame 72 which is attached to a vertical post 74 and base 68. Skiers 60, having ferromagnetic skis 62, are placed on the magnetic strip 12. The skis 62 could be made of plated iron or a molded plastic with a ferrous deposit. As the pulleys 14, 30 are rotated, the skiers 60 are pulled around to the top 22 of the upper pulley 14 by the magnetic loop 12. At the top 22 of the upper pulley 14, there is a ramp 40 adjacent the magnetic strip 12. Since the tip of the ski 62 is rounded upward, the ski 62 tip slides onto the top of the ramp 40. The back of the ski 62 is still being pushed by the magnetic loop 12. This pushes the ski figure 60 completely onto the ramp 40. The skier 60 is held at this location by a skier release mechanism 39 which will be discussed later when FIGS. 4A and 4B are described. After a short time, the skier 60 is released by the skier release mechanism 39 and slides down the ski ramp 40 and off the end, thereby performing a "ski jump." Similar to an actual ski jumper, the skier's horizontal momentum causes the skier 60 to initially move farther from the magnetic loop 12. Gravity will eventually cause enough downward acceleration to draw the skier 60 back to the magnetic loop 12 surface. After landing on the magnetic loop 12 again, the attraction between the skier's ski 62 and the loop 12 will draw the skier 60 to the central portion of the magnetic loop 12 (discussed later with the magnetic loop material 12) and hold the skier 60 in place against the loop 12, thereby allowing the skier 60 to be drawn as the pulleys 14, 30 move the loop 12.

As the skier 60 is drawn around on the magnetic loop 12, it will arrive at the positioning arm 86. The positioning arm 86 accomplishes two different things. If a skier 60 is mispositioned, for example if the skier 60 is turned backwards or sideways, the repositioning arm 86 will hit the ski pole 64 or ski 62, respectively, of the skier 60 and twist the skier 60 so that the skier 60 is once again facing forward. In this particular embodiment, the repositioning arm 86 also holds the magnetic loop 12 onto the pulleys 14, 30. Each pulley 14, 30 has a slight lip 16, 32 on the front edge 18, 34 of its wheel 14, 30 which prevents the magnetic loop 12 from sliding off the front edge 18, 34 of the pulley 14, 30. The repositioning arm 86 pushes the magnetic strip 12 gently towards the front edge 18, 34 of the pulley 14, 30 so that the magnetic strip 12 will not creep off the back edge 20, 36 of the pulley wheel 14, 30. In other embodiments, both the front 18, 34 and back 20, 36 of the pulley wheel 14, 30 may be raised such that the magnetic loop 12 is prevented from drifting off both the front 18, 34 and back 20, 36 of the pulley wheel 14, 30.

To further assure that the loop 12 stays in place, the pulleys 14, 30 may be crowned. This means that the center of the wheel 14, 30 has a slightly larger diameter than the front 18, 34 and back 20, 36 edges of the wheel 14, 30.

Between and approximately tangent to the upper surface 22, 38 of the upper 14 and lower 30 pulleys is an optional channel 90 or trough. This channel 90 partially surrounds the magnetic loop 12 and helps prevent the skier 60 from flying off of the magnetic strip 12 when the skier 60 lands. If the skier 60 is descending toward the loop 12 at a slight angle or is sliding sideways after hitting the loop 12, the ski 62 will run into one of the sidewalls of the channel 90 and stop and/or be redirected back into place. At the top of the channel 90, there is a roller 92. The magnetic loop 12 goes under the roller 92, thereby being held in place within the channel 90. The roller 92 also performs a second function, it pulls the magnetic loop 12 farther away from the ramp, and therefore the skier 60, as the skier 60 moves onto the top of the ski jump ramp 40, thereby allowing the skier 60 to release from the magnetic loop 12 more easily.

The ski jumping device 10 is designed to allow the user to adjust the angle of inclination of the magnetic loop 12 with respect to the support surface 76. This is accomplished by loosening a wingnut 78 which attaches the central frame 72 to a vertical post 74. When the wingnut 78 has been loosened, the user may then adjust the angle between the support surface 76 and the magnetic loop 12.

The user also has the ability to adjust the angle of the ski jump ramp 40 with respect to the magnetic loop 12. This could be accomplished in a couple of different ways. For example, the ramp 40 could pivot about its top end and have a sliding joint between the bottom of the ramp 40 and the central frame 72. Another option would have a single support which would hold the ramp 40 in relation to the central frame 72. The ramp 40 would be pivotally attached to the top of the support. A wingnut or other fixing member could be used at either or both of the pivot point and the sliding joint. This would allow the user to loosen the joints and adjust the angle between the ramp 40 and the support arm and thereby the overall angle of the ramp 40 to the central frame 72 and the magnetic loop 12. This adjusts the amount the skier 60 must drop before landing on the magnetic loop 12.

The two angle adjustments determine how far the skier 60 will fly before landing on the magnetic strip 12. The closer the magnetic loop 12 is to horizontal, the smaller the jump; and, the closer the jump ramp 40 is to being parallel with the magnetic loop 12, the smaller the jump.

Figure 3:
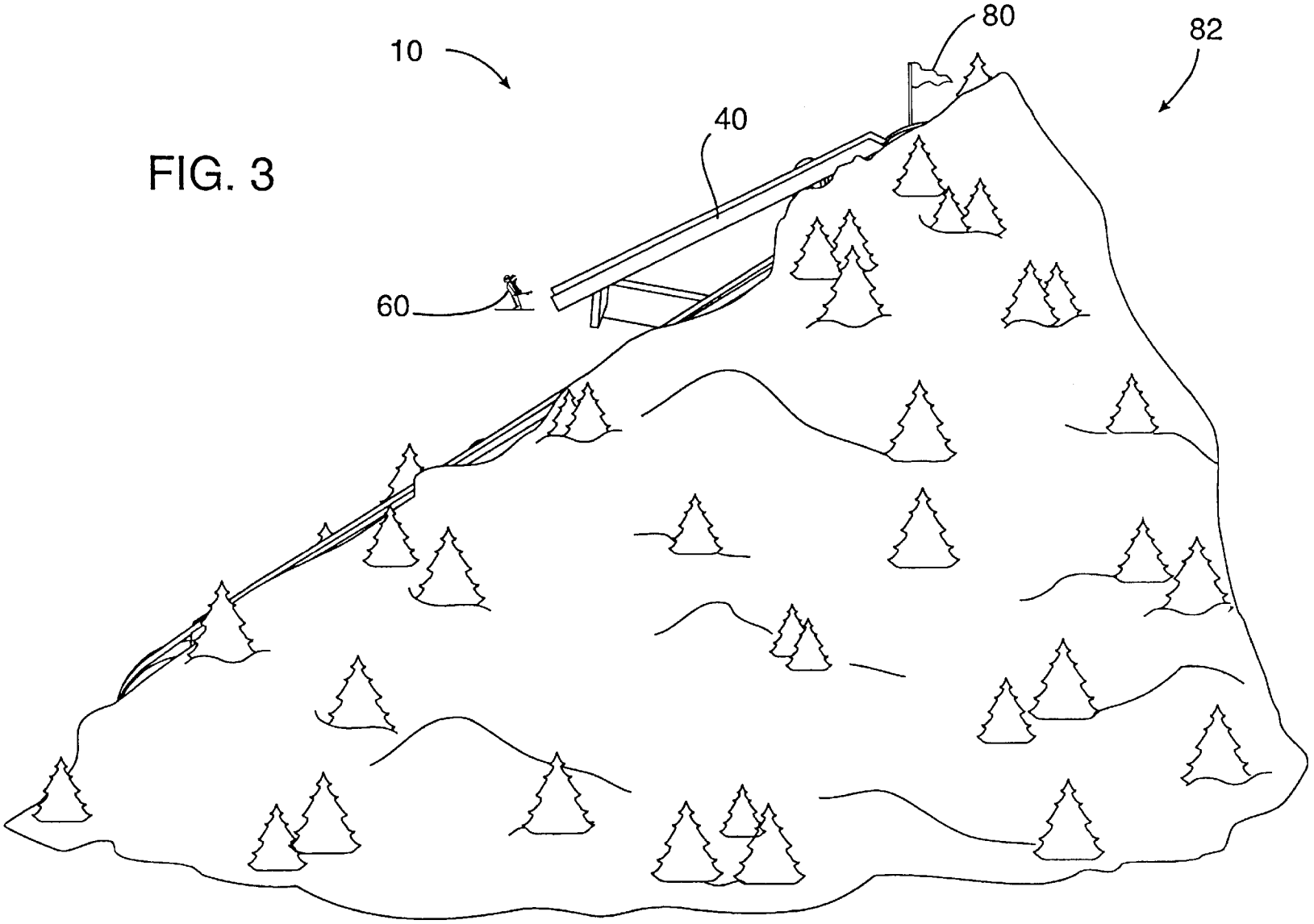
FIG. 3 is a front view of the ski jumping device in an embodiment which includes a simulated mountain.

FIG. 3 is a front view of the ski jumping device 10 in an embodiment which includes a simulated mountain 82. This view shows the ski jumping device 10 in a natural looking environment. The channel 90 of the ski jump device 10 would be made integral with the rest of the mountain 82. The ramp 40 would then stick out above the side of the mountain 82 as would be seen if one were looking at a side view of a full-sized mountain with an actual ski jump. Another option would have the ski jump ramp 40 itself integral with the mountain surface 82.

FIGS. 4A and 4B are close-up back views of the upper portion of the ski jumping device 10 showing the skier release mechanism 39. Attached to the back 36 of the upper pulley 14 is a cam 42. The cam 42 rotates at the same speed as the pulley 14. A lever arm 46 has a depending leg 47 with a roller 49 at the end which rests against the circumferential edge of the cam 42. A spring 54 holds the roller 49 against the cam 42. During most of the rotation of the cam 42, the second end 50 of the lever arm 46 is held against or adjacent to the underside of the top of the ramp 40. During a portion of the cam's 42 rotation, the lobe 44 of the cam 42 presses the first end 48 of the lever arm 46 upward. This rotates the lever arm 46 around its pivot point 56 so that the second end 50 of the lever arm 46 is moved away from the underside of the top of the ramp 40. Attached to the second end 50 of the lever arm 46 is a magnet 52. When the lever arm 46 is rotated toward the ramp 40, the magnet 52 is placed against or adjacent to the underside of the top of the ramp 40. This holds the skier 60 stationary while the magnet 52 is against the ramp 40 and releases the skier 60 to slid down the ramp 40 when the lever 46 is rotated away from the ramp 40. A secondary function of the magnet 52 is to help draw the skier 60 off of the magnetic loop 12 and fully onto the ramp 40. This occurs because the magnetic field created by the single magnet is stronger than the field created by the magnetic loop 12.

The skier release mechanism 39 holds the skier 60 for whatever period of time remains of the cycle, assuming a cycle ends with the lobe 44 pressing the first end 48 of the lever arm 46 up, thereby moving the second end 50 of the lever arm 46 and the magnet 52 away from the underside of the ramp 40. This means that the skier 60 is likely to be held for different periods of time for each jump, thereby increasing the visual interest of the ski jumping device 10.

There are a couple of variations on how the skier release mechanism 39 can operate. It could be left to the user to actuate the lever arm 46 that would release the skier 60, or even to rotate the cam 42. User actuation of the lever arm 46 would give the user an exact control over when the skier 60 was released. User rotation of the cam 42 would give the user control over the release of the skier 60, but not quite as exact as actuation of the lever 46. There could even be a separate motor for the release mechanism 39 that could run at constant or variable speed. Ultimately, the user could have a choice between one or more of these or other options for the release mechanism 39.

An alternate embodiment of the skier release mechanism 39 would use an electromagnet. This would be especially useful for a user actuated release mechanism 39 embodiment. In this case, there would be a button or switch that would temporarily shut the electromagnet off which would release the skier 60 to slid down the ramp 40.

The skier release mechanism 39 is not necessary for the present invention to function properly. If desired, the user may choose to omit the skier release mechanism 39. This would mean that the skier 60 would not pause at the top of the ramp 40, instead, assuming sufficient velocity of the magnetic loop 12, the skier 60 would remain in continuous motion. A different option would have more than one lobe 44 on the cam 42. This would decrease the average time that a skier 60 was held by the skier release mechanism 39.

Also attached to the cam 42 or the lever arm 46 is an optional flag 80. This would be set up so that the flag 80 would be rotated from a vertical position down towards a horizontal position to simulate a starter dropping the flag 80 to begin a race. As the cam 42 rotates farther, the flag 80 is raised back to vertical.

An ordinary electric motor 70 may be attached to one of the two pulleys 14, 30 to provide the force for rotating the pulleys 14, 30. If one of the pulleys 14, 30 is driven, then the second pulley 14, 30 will rotate due to friction caused by the motion of the magnetic loop 12. The motor 70 may be driven by standard AC power or it may be run by a DC battery or battery pack. For further user control, a variable motor could be used which would allow the user to choose the speed at which the magnetic loop 12 ran. This could be used to adjust the after-landing, downhill and returning, uphill speed of the skier 60 such that the downhill speed could correspond to the ramp 40 steepness, thereby more closely simulating an actual ski jumper. If the user wanted some options, but did not require the continuous adjustability of a variable motor, two or more standard motors with differing speeds could be optionally used to drive the loop 12.

With the exception of the base 62 of the ski figure 60 and the magnetic loop 12, the materials of the present invention can be virtually any material: metal, plastic, wood, fiberboard, ceramic, etc. The mountain 82 and other environment may be a plastic snow simulation or a batting or other soft material. The ski jump ramp 40 surface is preferably made of a low friction material such as a coating of teflon.

FIG. 5 is a side view of a skier figurine 60 which has been used to simulate a ski jumper. The figure 60 has ski poles 64 and ferromagnetic skies 62. In this particular embodiment, the left ski pole sticks out to hit the positioning arm 86 in cases where the skier 60 is backwards. The polarity of the ski 62 should be such that the skier 60 is encouraged to face forward on the magnetic loop 12.

Skiers are only one example of a type of figure 60 that may be used. You may use any type of figurine 60 having a ferromagnetic element 62. It could be shaped like a human, an animal such as a horse, an inanimate object such as a automobile, or even abstract designs. Other potential figurine 60 motifs include, a toboggan, bobsled, sleds, saucers, seals, whales, automobiles, motorcycles, surfboards, airplanes, and missiles. A figurine 60 configuration which will work with the particular magnetic loop 12 specified is a 0.6 gram total weight figure, the ski weighing 0.5 grams and the skier weighting 0.1 grams. The ski dimensions are 1.4×0.22×0.012 inches, and the skier dimensions are 0.08×0.25×1.125 inches. The listed configuration is given as an example only. Many other dimensions and configurations will also work. The scarf and fringe on the ski figurine 60 act as wind resistance elements 66 to keep the skier 60 upright as it drops onto the loop 12. These wind resistant elements 66 are an aerodynamic stabilizer. Without these elements 66, and depending on the other aerodynamic characteristics of the skier 60, the skiers 60 may tumble instead of remaining upright.

Figure 6B:
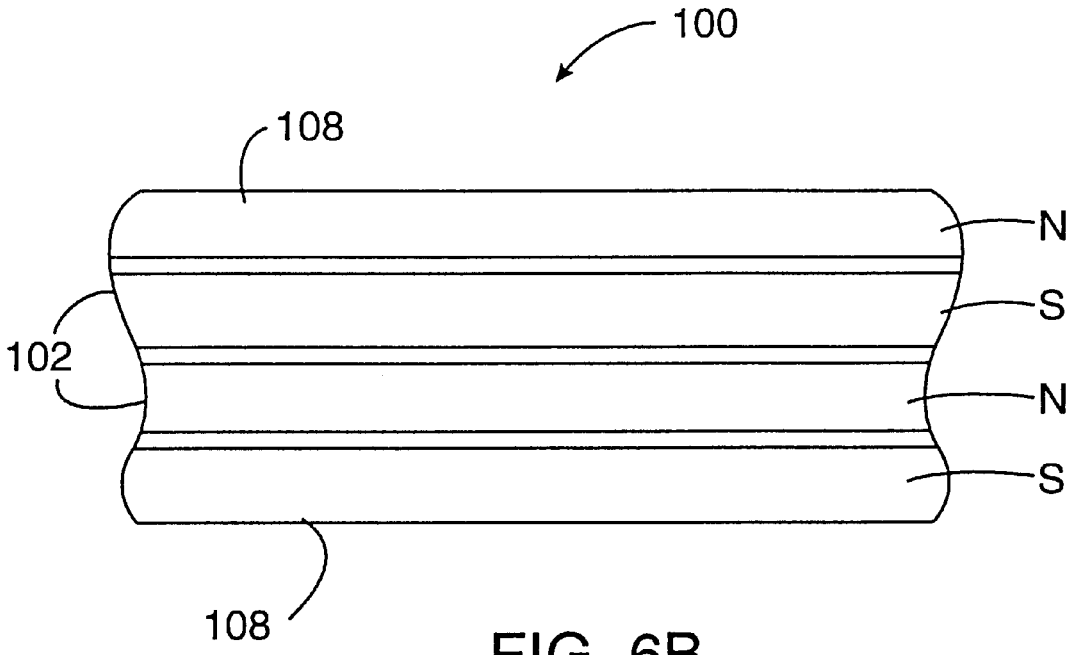
FIG. 6B is a close-up top view of the magnetic tape.
Figure 6A:
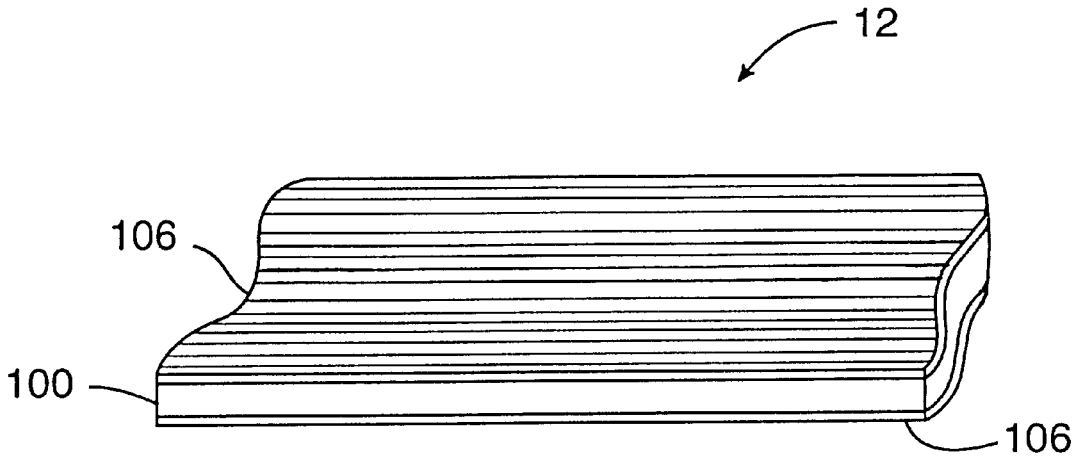
FIG. 6A is a close-up view of the magnetic loop.

FIG. 6A is a close-up view of the magnetic loop 12. Magnetic tape 100 is then covered by a filament tape 106. Although not necessary, the filament tape 106 provides an inelastic base for the magnetic material which prevents the magnetic tape 100 from being put under tension and stretching and/or cracking. The filament tape 106 may be place on one or both sides of the of magnetic tape 100. If the filament tape 106 is placed on the top of the magnetic tape 100, it prevents wearing of the tape 100. This can be important when the device 10 is run for long periods of time. As the skiers 60 land on the strip 12, they abrade of a small amount of the magnetic tape 100 material which is attracted and sticks to the bottom the ski 62. This interferes with the skier's 60 sliding down the ramp 40.

FIG. 6B is a close-up top view of the magnetic tape 100. In the embodiment described, the magnetic loop 12 is designed such that the strip's 12 polarity has the poles 102 located as stripes running parallel to the edges 108 of the strip 12. A good example of a material of this type is a flexible magnetic tape 100 by Edmund Scientific (part #37497). This particular tape 100 is ½ inch wide and 0.032 of an inch thick and has four poles 102. Many brands of this type of tape 100 are made of powdered ferrite and rubber material such as Hypolon™ (Trademark of Dupont). Since the magnetic loop 12 has four poles 102, the strongest pull for the magnetic ski 62 is at the center of the strip 12. This pulls the skier 60 to the center of the strip 12 and helps prevent the skier 60 from leaving the magnetic loop 12. The polarities of the magnetic loop 12 and the figurine base 62 also help assure that the skier 60 is facing directly forward. Currently, a four pole magnetic tape 100 is preferred; however, there are other possible configurations for the magnetic loop 12. The magnetic loop 12 may also be made with a single, two or many poles on the top surface of the loop 12.

Figure 7:
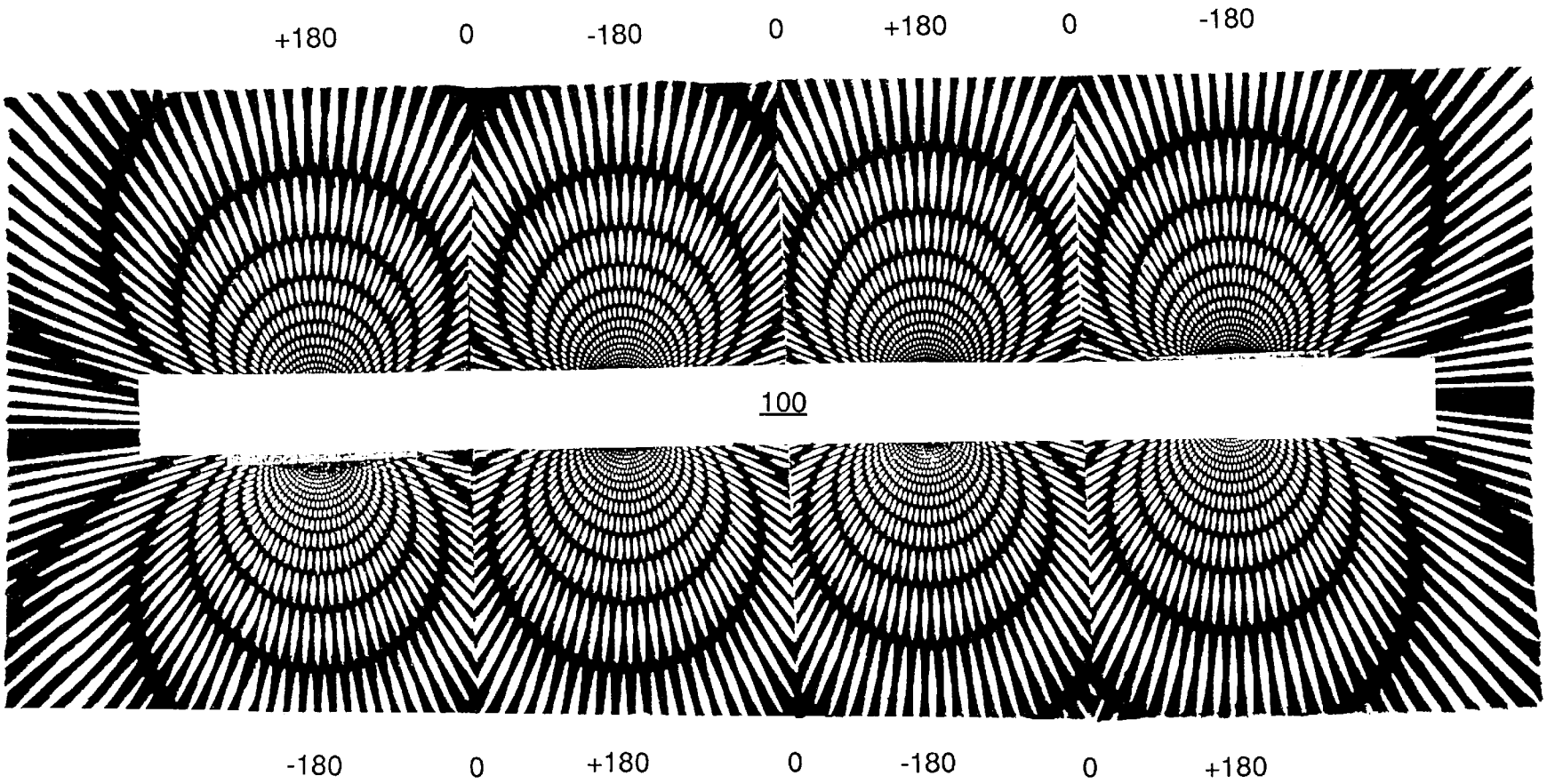
FIG. 7 is a visual interpretation of the magnetic fields of a four pole magnetic tape.

FIG. 7 is a visual interpretation of the magnetic field intensity of a cross section of the four-pole magnetic tape 100. As you move from side to side across the magnetic material, the intensity of the field shifts from −180 to 0 to +180 and back to 0. For the four pole strip of magnetic tape shown, this pattern continues for a second cycle. As discussed above, configuration seems the most effective for drawings the skier towards the center of the magnetic loop 12.

The drawing figures and above example are for a particular configuration, alternate embodiments are also possible. For example, multiple tracks could use a common drive. This would allow a user to have ski jump ramps down more than one side of a mountain or have parallel tracks performing a ski jump competition, etc. Another configuration could use multiple drives to run multiple tracks. This would allow the user to have various speeds all running simultaneously and independently adjust each run.

Although the examples given include many specificities, they are intended as illustrative of only one possible embodiment of the invention. Other embodiments and modifications will, no doubt, occur to those skilled in the art. For example, the magnetic loop 12 could be formed with a system of magnetic beads which are strung on cables, or a set of magnetic tubes welded or otherwise attached together could form the strip 12 of material. A further variation would use an linear array of magnets which would activate in sequence to propel the skier 60 with or without the magnetic loop 12. Thus, the examples given should only be interpreted as illustrations of some of the preferred embodiments of the invention, and the full scope of the invention should be determined by the appended claims and their legal equivalents.

I claim:

1. An amusement device, comprising:

(a) a first pulley, a second pulley, an endless and continuous loop of magnetic material, said loop of magnetic material located around said first pulley and said second pulley, a ramp having a first end, said first end of said ramp located adjacent said loop of magnetic material, (b) and at least one member having a ferromagnetic element, (c) Said loop constrained to be removed from said member during a portion of said ramp freeing said member from magnetic interaction.

2. The amusement device of claim 1 wherein said loop of magnetic material has at least one magnetic pole running parallel to an edge of said loop of magnetic material.

3. The amusement device of claim 2 wherein said at least one magnetic pole is at least four magnetic poles.

4. An amusement device, comprising:

(a) a first pulley, a second pulley, an endless loop of magnetic material, said loop of magnetic material located around said first pulley and said second pulley, said loop of magnetic material having a polarity, a ramp having a first end, said first end of said ramp located adjacent said loop of magnetic material, (b) and at least one member having a ferromagnetic element and configured to enhance said at least one member's aerodynamic stability, (c) Said loop constrained to be removed from said member during a portion of said ramp freeing said member from magnetic interaction, wherein when said at least one member is facing forward, said polarity is oriented such that said ferromagnetic element is attracted to said loop of magnetic material.

5. The amusement device of claim 4 further comprising a release mechanism, said release mechanism temporarily holding said at least one member at a chosen point proximate said loop of magnetic material.

6. The amusement device of claim 5 wherein said chosen point proximate said loop of magnetic material is on said first end of said ramp.

7. The amusement device of claim 5 wherein said release mechanism is comprised of an electromagnetic device located adjacent said chosen point proximate said loop of magnetic material and an actuator means for de-energizing said electromagnetic device.

8. The amusement device of claim 5 wherein said release mechanism is comprised of:

a lever arm having a first end located adjacent said chosen point proximate said loop of magnetic material, and a magnet attached to said first end of said lever arm.

9. The amusement device of claim 8 wherein said release mechanism further comprises a cam and wherein said lever arm has a second end, said second end located adjacent said cam.

10. The amusement device of claim 9 wherein said cam is attached to said first pulley.

11. The amusement device of claim 9 wherein said release mechanism further comprises a biasing means for biasing said lever arm to press against said cam.

12. The amusement device of claim 4 wherein said at least one member is configured to enhance said at least one member's aerodynamic stability.

13. The amusement device of claim 12 wherein the configuration includes at least one wind resistant element.

14. The amusement device of claim 4 further comprising a positioning arm, said positioning arm located adjacent said loop of magnetic material.

15. The amusement device of claim 14 wherein said at least one member has at least one depending projection and said positioning arm is located such that if said at least one member is improperly positioned when said at least one member passes said positioning arm, said positioning arm will contact one of said at least one depending projection and correctly position said at least one member.

16. The amusement device of claim 4 wherein said first pulley and said second pulley have a shape which hinders movement of said loop of magnetic material off of said first pulley and said second pulley.

17. The amusement device of claim 16 wherein said shape includes at least one chosen from the group consisting of a crown around a middle of said first pulley, a crown around a middle of said second pulley, a lip on an edge of said first pulley, and a lip on an edge of said second pulley.

18. The amusement device of claim 4 wherein said loop of magnetic material has at least one magnetic pole running parallel to an edge of said loop of magnetic material.

19. The amusement device of claim 18 wherein said at least one magnetic pole is at least four magnetic poles.

20. The amusement device of claim 4 wherein said ferromagnetic element has a first polarity and said loop of magnetic material has a second polarity and wherein when said at least one member is facing forward, said first polarity and said second polarity are oriented such that said ferromagnetic element and said loop of magnetic material are mutually attracted.

21. The amusement device of claim 4 further comprising a channel, a portion of said loop of magnetic material located within said channel.

22. The amusement device of claim 4 wherein said loop of magnetic material is a continuous strip of magnetic material.

23. A method for making a figurine perform a ski jump, the method comprising the steps of:

(a) attracting a figurine having a magnetic element to a loop of magnetic material;

(b) moving said loop of magnetic material around a first pulley and a second pulley;

(c) removing said figurine from magnetic contact with said loop of magnetic material;

(d) sliding said figurine down a ramp, a first end of said ramp being adjacent said loop of magnetic material and a second end of said ramp spaced apart from said loop of magnetic material, said figurine sliding from said first end to said second end;

(e) allowing said figuring to drop from said second end of said ramp;

(f) and reattracting said figuring to said loop of magnetic material.

24. The method of claim 23 further comprising the steps of:

(g) holding said figurine adjacent said first end of said ramp;

(h) releasing said figurine.

25. The method of claim 23 wherein said figurine has a front side, the method further comprising the step of:

(g) adjusting the position of said figurine such that said front side of said figurine faces the direction in which the figurine is moving.

26. The method of claim 23 wherein the magnetic attraction of steps (a) and (f) is amplified by providing said loop of magnetic material with a plurality of poles running parallel with an edge of said loop of magnetic material.

* * * * *